US006997581B1

(12) United States Patent
Shelton et al.

(10) Patent No.: US 6,997,581 B1
(45) Date of Patent: Feb. 14, 2006

(54) DECORATIVE LAMP DISPLAY PANEL WITH CLAMP SUPPORT MEMBER

(76) Inventors: Dairen Shelton, 32 Bramford St., Ladera Ranch, CA (US) 92694; Shawn Xifo, 18 Bramford St., Ladera Ranch, CA (US) 92694; Mark McKenzie, P.O. Box 16484, Irvine, CA (US) 92623

( * ) Notice: Subject to any disclaimer, the term of this patent is extended or adjusted under 35 U.S.C. 154(b) by 18 days.

(21) Appl. No.: 10/329,610

(22) Filed: Dec. 26, 2002

(51) Int. Cl.
*F21V 11/18* (2006.01)

(52) U.S. Cl. ..... 362/359; 362/311; 362/361

(58) Field of Classification Search ..... 362/151, 362/152, 255, 256, 431, 361, 359, 446, 367, 362/455, 353, 320, 311, 277, 278, 3, 16, 17, 362/18, 257, 282, 317, 319, 351, 355, 383, 362/396, 418, 430, 433, 437, 438, 443, 448, 362/452; 40/554, 606.1, 124.01, 124.02, 40/489, 541, 553, 559, 584, 611.01, 611.06, 40/611.012, 607.14
See application file for complete search history.

(56) References Cited

U.S. PATENT DOCUMENTS

| | | | | | |
|---|---|---|---|---|---|
| 85,921 | A | * | 1/1869 | Foster | 362/351 |
| 172,137 | A | * | 1/1876 | Martine | 362/433 |
| 945,356 | A | * | 1/1910 | Wilson | 362/322 |
| 1,463,183 | A | * | 7/1923 | Warner | 362/287 |
| 1,591,206 | A | * | 7/1926 | Baum et al. | 362/294 |
| 2,700,100 | A | * | 1/1955 | Wissinger | 362/320 |
| 3,456,106 | A | * | 7/1969 | Gluschkin | 362/98 |
| 3,829,681 | A | * | 8/1974 | Fuss | 362/283 |
| 4,074,123 | A | * | 2/1978 | Wissinger | 362/319 |
| 5,115,385 | A | * | 5/1992 | Jeckle | 362/358 |
| 5,128,838 | A | * | 7/1992 | Brandess | 362/18 |
| D383,243 | S | * | 9/1997 | Fry et al. | D26/118 |

* cited by examiner

*Primary Examiner*—Thomas M. Sember
*Assistant Examiner*—Ismael Negron
(74) *Attorney, Agent, or Firm*—Charles C. Logan, II

(57) ABSTRACT

A decorative lamp display panel assembly for attachment to out door wall/post lanterns, or like structure, such assembly having a removable display panel having a decorative picture and/or indicia thereon. A top frame member is releasably secured to the top edge of the display panel and a bottom frame member is releasably secured to the bottom edge of the display panel. A support arm assembly is connected to the top frame member at a front end, and to a clamp member at the rear end. The clamp member has finger members that can be bent outwardly so that they can be attached to different diameter structure on an outdoor lantern. The support arm assembly can be extended and retracted, and it can be adjusted to different vertical angles to vary the height of the top frame member with respect to the clamp member.

13 Claims, 2 Drawing Sheets

DECORATIVE LAMP DISPLAY PANEL WITH CLAMP SUPPORT MEMBER

BACKGROUND OF THE INVENTION

The invention relates to display panels and more specifically to a decorative light fixture display panel assembly that can be removably secured to an outdoor wall lantern, an outdoor post lantern or similar type structure.

In the past display panels that are illuminated have been incorporated in several types of structures. The Busick et al U.S. Pat. No. 2,177,204 illustrates a picture display panel that is incorporated into a lamp shade.

Other types of illuminated displays are known for displaying house numbers and the house owners names. The Witz U.S. Pat. No. 2,798,323 discloses a box-like housing that is attached to the bottom skirt of a standard porch light fixture. The Espinosa U.S. Pat. No. 3,516,187 discloses a housing that is mounted on a conventional outdoor electrical bracket B which is shown by dotted lines. The Donelan U.S. Pat. No. 4,887,195 discloses a structure that is mounted on an outdoor light fixture.

The Arnold U.S. Pat. No. 3,680,238 discloses a sign display apparatus in which the message of a sign can be readily changed. The Moore U.S. Pat. No. 4,953,067 discloses an illuminated house number sign that would be mounted on a conventional threaded socket located on a porch ceiling or overhang of a house or other building.

The Taylor et al U.S. Pat. No. 5,048,212 discloses a device for illuminating residence information on the vertical exterior of a lamp post.

The Nurre U.S. Pat. No. 5,598,652 discloses a lamp with a changeable display date. The Gabrius et al U.S. Pat. No. 6,105,291 discloses an internally illuminated sign mountable on a lighting track. The Downing U.S. Pat. No. 6,135,622 discloses a changeable visual display lamp.

SUMMARY OF THE INVENTION

The decorative light fixture display panel assembly has been primarily designed to be used with outdoor wall lanterns, outdoor post lanterns and similar type of structure. When assembled, it utilizes a single display panel. However, the intention is to have multiple display panels so that they can be interchanged according to the season or greeting that one wants to show on the display panel. During the daytime the decorative scenes on the display panel are readily viewable. At night, the outdoor lantern positioned behind the display panel illuminates the picture and indicia.

The top and bottom edges of the display panel are captured and detachably secured to the respective top frame member and bottom frame member. Each of the respective frame members has a arcuate front surface for removably receiving the respective top and bottom edges of the display panel. The display panel in its static state would be a planar sheet member made of a material that allows it to be bent easily into the curvature required for the respective grooves in the frame members. Self-locking pins are passed through aligned apertures in the respective frame members and display panel to allow the respective components to be quickly and easily assembled and disassembled. The frame members would preferably be made of a plastic material and the display panels would also be made of a plastic material.

Detachably secured to the rear of the top frame member is the front end of a support arm assembly. The rear of the support arm assembly is removably secured to the rear end of a clamp member. The support arm assembly would preferably include a pair of slider support arms that are telescopically adjustable with respect to each other. This allows the spacing between the display panel and the outdoor lantern to be adjusted according to size and shape of the outdoor lantern. The support arm assembly is also adjustable angularly in a vertical direction at its front end and at its rear end to provide added adjustability based upon the shape or configuration of the outdoor lantern. Additionally, the individual slider support arms can be angularly adjusted with respect to each other or they can be secured to together in longitudinal alignment.

The clamp member is preferably made of a plastic or rubber material and it has a pair of laterally spaced integral finger members each having a front tip. The finger members have an outer surface and their inner surface has a longitudinally spaced concave recess and inner concave recesses. The radiuses of each of these respective recesses are different so that the inner surface of the finger members can grip different structure on the outdoor lantern having different diameters. The finger members have multiple open spaces between their respective inner and outer surface to provide collapsibility and flexibility when it is necessary for the finger members to be spread apart in order to be positioned around structures such as a filial or neck portion on an outdoor lantern.

Some examples of the scenes or indicia that would be on the different display panels would relate to the different seasons of the year, special occasions, birthdays, etc.

DESCRIPTION OF THE PREFERRED EMBODIMENT

Figure 1:
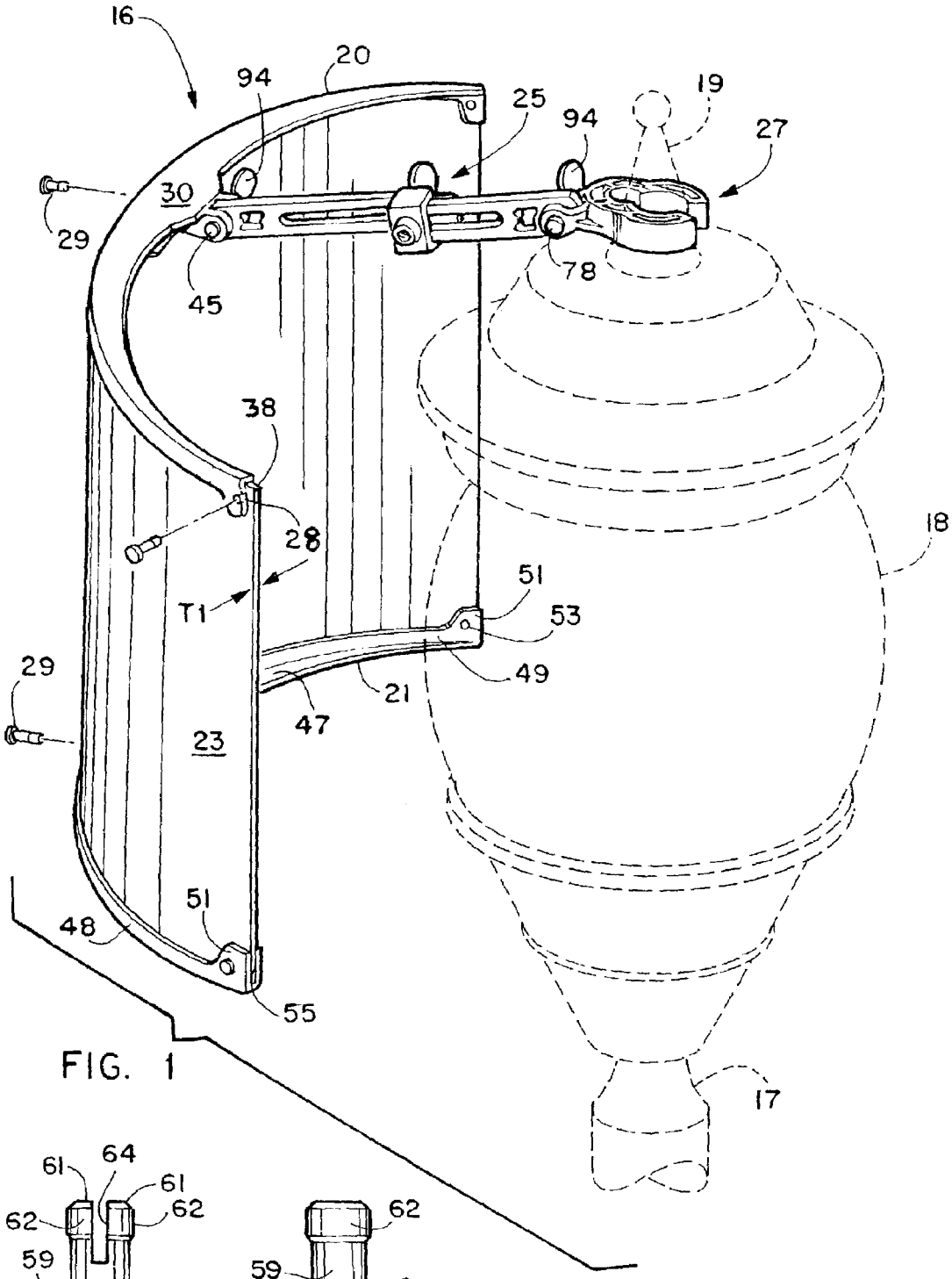
FIG. 1 is a rear perspective view of the novel decorative light fixture display panel assembly mounted on an outdoor post lantern that is shown in phantom lines.

The decorative light fixture display panel assembly is generally designated numeral 16 and it is illustrated in its assembled state in FIG. 1. It is mounted on an outdoor post lantern 18 that is illustrated in dotted lines. The outdoor post lantern is also intended to be similar in structure to an outdoor wall lantern.

Display panel assembly 16 has a top frame member 20, a bottom frame member 21, a display panel 23, a support arm assembly 25 and a clamp member 27 as its major components. Display panel 23 would be interchangeabe with other display panels and the different display panels would have pictorial scenes, written indicia, etc. recognizing different holidays, birthdays, birth announcements, etc. The display panels would be readily viewable during the daylight hours and in the evening they would be illuminated from behind by the outdoor lantern.

Display panel assembly 16 would normally be mounted on the outdoor post lantern 18 with clamp member 27 securely gripping the finial 19 at the top of the outdoor post lantern. Alternatively, the display panel assembly could be inverted so that the clamp 27 would firmly grip the neck portion 17 of the outdoor post lantern. Outdoor post lantern 18 could also be described as an outdoor wall lantern if it had structure that could support it from the outside surface of a wall structure.

Display panel 23 has a generally rectangular shape and it is made from a flat sheet of plastic material having a thickness T1 in the range of 0.01–0.250 inches. In the preferred embodiment, the display panel would have apertures 28 adjacent the four corners thereof and a central aperture adjacent the respective top and bottom edges through which the self-locking pins 29 would be inserted (in a manner later to be described.) Display panels 23 would be made of a flexible material so that they can be easily bent in a curvature that would conform to the curvature of the top frame member 20 and the bottom frame member 21.

Figure 2:
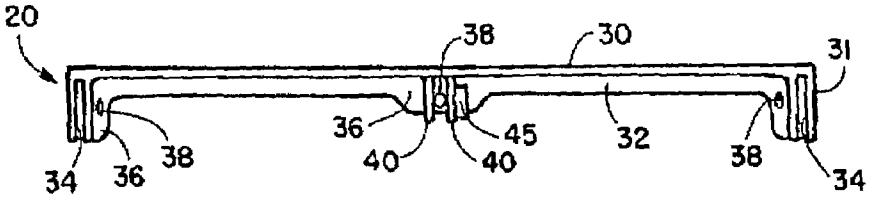
FIG. 2 is a rear elevation view of the top frame member.
Figure 3:
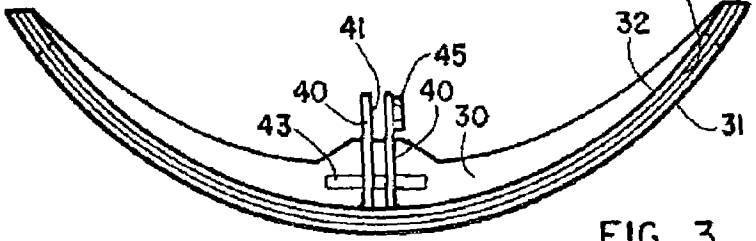
FIG. 3 is a bottom plan view of the top frame member.
Figure 4:
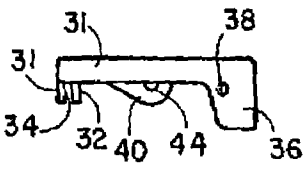
FIG. 4 is a left side elevation view of the top frame member.
Figure 5:
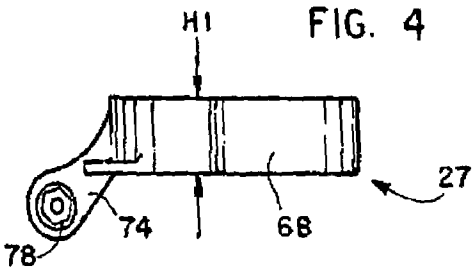
FIG. 5 is a right side elevation of the clamp member.
Figure 6:
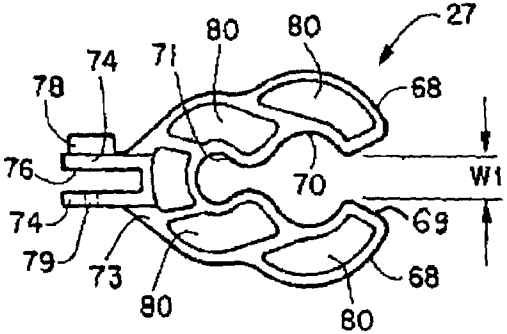
FIG. 6 is a bottom plan view of the clamp member.

Referring to FIGS. 2–4, the structure of top frame member 20 will now be described. It has a top wall 30 having an integrally formed downwardly extending outer flange 31 and a downwardly extending inner flange 32. These respective flanges are laterally offset from each other to form an arcuate groove 34 that extends from the left end of the top frame member 20 to its right end. In an alternative embodiment, the left and right ends of groove 34 could be closed by an end wall portion on the top frame member 20. The respective inner flange 32 and outer flange 31 have ear portions 36 formed at both their opposite ends and in the central area. These ear portions have aligned apertures 38 that removably receive the self-locking pins 29 that pass through the apertures 28 in display panel 23. Formed integrally with the rear surface of inner flange 32 and the bottom surface of top wall 30 are bracket arms 40 that are laterally spaced from each other to form a slot 41. A stiffening member 43 extends downwardly from the bottom surface of top wall 30 to give structural integrity to bracket arms 40. One of the bracket arms 40 has an integrally formed internally threaded nut 45 that aligns with an aperture 44 in the other bracket arm 40.

The bottom frame member 21 will be substantially identical to top fame member 20. However the bracket arms 40 and stiffening member 43 would not necessarily be required. Bottom frame member 21 is illustrated in FIG. 1 having a bottom wall 47, an outer flange 48 and an inner flange 49. Each of the respective flanges would have ear portions 51 each having aligned apertures 53. The respective inner flange 49 and outer flange 48 are laterally offset from each other to form a groove 55 for receiving the bottom edge of the display panel 23. Top frame member 20 and bottom frame member 21 would preferably be made of plastic material although other materials could also be used.

Figure 11:
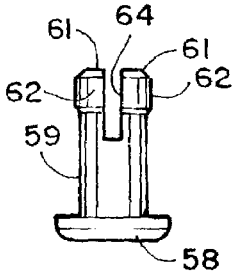
FIG. 11 is a top plan view of the self-locking pin.
Figure 12:
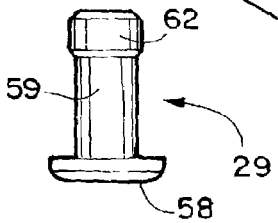
FIG. 12 is a left side elevation view of the self-locking pin.

The self-locking pins 29 are illustrated in FIGS. 11 and 12. They would preferably be made of a plastic material. They have a head 58 and a shank portion 59. A pair of legs 61 extend from the rear end of shank portion 59 and each has a shoulder 62 adjacent its outer end. The legs 61 are laterally spaced from each other to form a slot 64. When the legs 61 are inserted through aligned apertures in the frame members and the display panel, they would be compressed in order to pass through these respective apertures and once passed therethrough would snap outwardly to lock the respective structures together.

Clamp member 27 is preferably molded from a rubber or plastic type material that has a sufficient degree of rigidity and yet is flexible enough to have its finger members 68 spread apart a sufficient width in order to capture structure on an outdoor lantern such as illustrated in FIG. 1. Finger members 68 each have a front tip 69 and they are laterally spaced from each other in their static state a distance W1 and W1 is in the range 0.375–1.00 inches. Each of the finger members has an inner surface having an outer concave recess 70 and an inner concave recess 71 which are designed to grip structures having different diameters or widths. The rear end of finger members 68 are connected to a body portion 73 that has a pair of support arms 74 extending rearwardly therefrom. The support arms 74 are laterally spaced from each other to form a slot 76 therebetween. One of the support arms has an integrally formed internally threaded nut 78 whose aperture aligns with an aperture 79 in the other support arm 74. The apertures 80 in the respective finger members 68 allow the structure of the finger members to be compressed when they are spread apart for the purpose of attaching then to the structure of an outdoor lantern. Finger members 68 have a height H1 and H1 is in the range of 0.375–2.00 inches.

Figure 7:
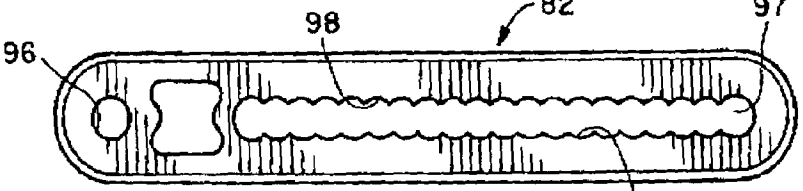
FIG. 7 is a side elevation view of the slider support arm.
Figure 10:
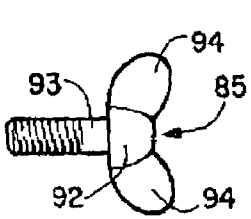
FIG. 10 is a side elevation view of the bolt.
Figure 9:
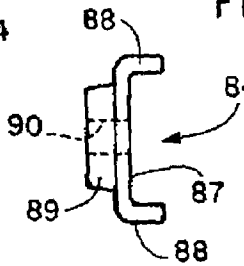
FIG. 9 is a right side elevation view of the anti-rotation clip.
Figure 8:
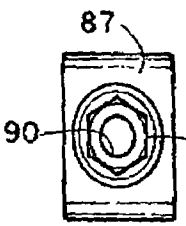
FIG. 8 is a front elevation view of the anti-rotation clip.

A slider support arm 82 is illustrated in FIG. 7 and a pair of these slider support arms are normally used in support arm assembly 25. They are connected together by an anti-rotation clip 84 and a bolt 85. Anti-rotation clip 84 has a central wall 87 with a pair of laterally spaced flanges or lips 88. An internally threaded nut 89 is formed on the outer surface of central wall 87. Internally threaded nut 89 has a bore hole 90. Bolts 85 have a head 92, a shank 93 and finger gripping ears 94.

Slider support arms 82 have an aperture 96 formed adjacently their one end and a slot 97 that starts adjacently the other end and extends internally a majority of the length of the slider support arm 82. Slot 97 has a plurality of scalloped upper concave recesses 98 and a plurality of scalloped lower concave recesses 99 that extend along its length and they aid in controlling the longitudinal adjustment of the respective slider support arms and their longitudinal adjustment about the shank 93 of bolt 85. The use of the two slider support arms 82 allows the spacing between the display panel 23 and the outdoor post lantern 18 to be adjusted according to the size and shape of the outdoor post lantern. Additionally, the angle of the slider support arms 82 can be adjusted up or downwardly and they can also be adjusted to form an obtuse angle of the two respective slider support arms 82 themselves. Slider support arms 82 are preferably made of a plastic material but they could be made of other types of material. The use of the internally threaded nuts 45, 78 and 89 on their respective structures eliminate a need for washers and allows the bolts 85 to be tightened using only a single hand to a degree of tightness that prevents wobble or slop between the respective connecting members.

What is claimed is:

1. A decorative light fixture display panel assembly comprising:

a display panel having a top edge, a bottom edge, a left edge, a right edge and a thickness T1;

an elongated top frame member having an arcuate-shaped top wall when observed in a top plan view; said top wall having a front edge; a rear edge, a top surface, a bottom surface, a left end and a right end; an outer flange extends downwardly from said front edge; an inner flange having a top edge extends downwardly from said bottom surface of said top wall; said inner flange is offset rearwardly from said outer flange to form an arcuate groove that extends from said left end of said top wall to said right end of said top wall; said rear edge of said top wall is offset rearwardly from said top edge of said inner flange to form a crescent-shape web of material therebetween;

said top edge of said display panel is removably received in said arcuate groove in said bottom surface of said top wall;

means for detachably securing said display panel to said top frame member;

a clamp member having a pair of laterally spaced finger members each having a front tip and a rear end; said finger members are oriented substantially horizontally; said respective rear ends of said finger members being connected to a body portion of said clamp member; said respective front tips being spaced horizontally from each other, in their static unflexed state, a predetermined and substantial fixed width W1; said finger members having a height H1 and H1 is in the range of 0.375–2.0 inches;

a support arm assembly having a front end and a rear end;

means for securing said rear end of said support arm assembly to said bottom surface of said top wall of said top frame member between said rear edge of said top wall and said top edge of said inner flange; and means for securing said front end of said support arm assembly to said rear end of said clamp member, and providing angular adjustment between said clamp member and said support arm.

2. A decorative light fixture display panel assembly as recited in claim 1 further comprising a bottom frame member having a front edge; said bottom frame member having an outer flange extending upwardly from said front edge of said bottom frame member.

3. A decorative light fixture display panel assembly as recited in claim 1 in combination with outdoor post lantern having a finial; said finger members being clamped around said finial of said outdoor post lantern.

4. A decorative light fixture display panel assembly as recited in claim 3 further comprising the means for adjusting the lateral distance between said display panel and said outdoor post lantern to properly accept the particular size and shape of said outdoor post lantern.

5. A decorative light fixture display panel assembly as recited in claim 1 in combination with an outdoor wall lantern having a finial; said finger members being clamped around said finial of said outdoor wall lantern.

6. A decorative light fixture display panel assembly as recited in claim 5 further comprising means for adjusting the lateral distance between said display panel and said outdoor wall lantern to properly accept the particular size and shape of said outdoor wall lantern.

7. A decorative light fixture display panel assembly as recited in claim 1 wherein said display panel is substantially planar in its static state prior to being detachably secured to said top frame member.

8. A decorative light fixture display panel assembly as recited in claim 7 wherein said display panel is made of a material that can be bent into an arcuate shape.

9. A decorative light fixture display panel assembly as recited in claim 7 wherein T1 is in the range of 0.010–0.250 inches.

10. A decorative light fixture display panel assembly as recited in claim 7 wherein said display panel is rectangular in shape.

11. A decorative light fixture display panel assembly comprising:

a display panel having a top edge, a bottom edge, a left edge, a right edge and a thickness T1;

an elongated top frame member having an arcuate-shaped top wall when observed in a top plan view; said top wall having a front edge, a rear edge, a top surface, a bottom surface, a left end and a right end; an outer flange extends downwardly from said front edge; an inner flange having a top edge extends downwardly from said bottom surface of said top wall; said inner flange is offset rearwardly from said outer flange to form an arcuate groove that extends from said left end of said top wall to said right end of said top wall; said rear edge of said top wall is offset rearwardly from said top edge of said inner flange to form a crescent-shaped web of material therebetween;

said top edge of said display panel is removably received in said arcuate groove in said bottom surface of said top wall;

means for detachably securing said display panel to said top frame member comprising a plurality of apertures in the said display panel adjacent said top edge, a plurality of apertures in said outer flange of said top frame member that align with said apertures in said display panel and a pin removably inserted in each of said aligned apertures;

a clamp member having a pair of laterally spaced finger members each having a front tip and a rear end; said finger members are oriented substantially horizontally; said respective rear ends of said finger members being connected to a body portion of said clamp member; said respective front tips being spaced horizontally a predetermined width W1 from each other in their static unflexed state; said finger members having a height H1 and H1 is in the range of 0.375–2.0 inches;

a support arm assembly having a front end and a rear end;

means for securing said front end of said support arm assembly to said rear end of said clamp member; and means for securing said rear end of said support arm assembly to said bottom surface of said top wall of said top frame member between said rear edge of said top wall and said top edge of said inner flange.

12. A decorative light fixture display panel assembly as recited in claim 11 wherein said pins have a self-locking structure.

13. A decorative light fixture display panel assembly comprising:

a display panel having a top edge, a bottom edge, a left edge, a right edge and a thickness T1;

an elongated top frame member having an arcuate-shaped top wall when observed in a top plan view; said top wall having a front edge, a rear edge, a top surface, a bottom surface, a left end and a right end; an outer flange extends downwardly from said front edge; an inner flange having a top edge extends downwardly from said bottom surface of said top wall; said inner flange is offset rearwardly from said outer flange to form an arcuate groove that extends from said left end of said top wall to said right end of said top wall; said rear edge of said top wall is offset rearwardly from said top edge of said inner flange to form a crescent-shaped web of material therebetween;

said top edge of said display panel is removably received in said arcuate groove in said bottom surface of said top wall;

a clamp member having a pair of laterally spaced finger members each having a front tip and a rear end; said finger members are oriented substantially horizontally; said respective rear ends of said finger members being connected to a body portion of said clamp member; said respective front tips being spaced horizontally a predetermined width W1 from each other in their static unflexed state; said finger members having a height H1 and H1 is in the range of 0.375–2.0 inches;

a support arm assembly having a front end and a rear end; said support arm assembly comprising a plurality of elongated slider support arms each having a longitudinally extending slot in their interior that allows their combined assembled length to be telescopically lengthened and shortened as desired;

means for securing said front end of said support arm assembly to said rear end of said clamp member; and means for securing said rear end of said support arm assembly to said bottom surface of said top wall of said top frame member between said rear edge of said top wall and said top edge of said inner flange.

* * * * *